US012082766B2

(12) United States Patent
Zhong et al.

(10) Patent No.: US 12,082,766 B2
(45) Date of Patent: Sep. 10, 2024

(54) DUST CUP AND VACUUM CLEANER HAVING THE SAME

(71) Applicants: JIANGSU MIDEA CLEANING APPLIANCES CO., LTD., Suzhou (CN); MIDEA GROUP CO., LTD., Foshan (CN)

(72) Inventors: Min Zhong, Suzhou (CN); Xuebing Yin, Suzhou (CN); Tom Ford, Suzhou (CN); Yuanfu Xu, Suzhou (CN); Jingying Guo, Suzhou (CN); Xia Xu, Suzhou (CN)

(73) Assignees: JIANGSU MIDEA CLEANING APPLIANCES CO., LTD., Suzhou (CN); MIDEA GROUP CO., LTD., Foshan (CN)

( * ) Notice: Subject to any disclaimer, the term of this patent is extended or adjusted under 35 U.S.C. 154(b) by 8 days.

(21) Appl. No.: 17/783,638

(22) PCT Filed: Sep. 1, 2020

(86) PCT No.: PCT/CN2020/112895
§ 371 (c)(1),
(2) Date: Jun. 8, 2022

(87) PCT Pub. No.: WO2021/114744
PCT Pub. Date: Jun. 17, 2021

(65) Prior Publication Data

US 2023/0020024 A1 Jan. 19, 2023

(30) Foreign Application Priority Data

Dec. 13, 2019 (CN) ..... 201911283764.5

(51) Int. Cl.
*A47L 9/16* (2006.01)
*A47L 5/24* (2006.01)

(52) U.S. Cl.
CPC ..... *A47L 9/1683* (2013.01); *A47L 5/24* (2013.01); *A47L 9/1666* (2013.01)

(58) Field of Classification Search
USPC ..... 15/347
See application file for complete search history.

(56) References Cited

U.S. PATENT DOCUMENTS 5,935,279 A 8/1999 Kilstrom
8,048,180 B2 * 11/2011 Oh ..... A47L 9/1683 15/352

(Continued)

FOREIGN PATENT DOCUMENTS

CN 202211651 U 5/2012
CN 208941986 U 6/2019

(Continued)

OTHER PUBLICATIONS

ISR for PCT Application No. PCT/CN2020/112895 mailed Nov. 27, 2020.

(Continued)

*Primary Examiner* — David S Posigian
*Assistant Examiner* — Jacob Adam Montgomery

(57) ABSTRACT

Provided are a dust cup and a vacuum cleaner having the same. The dust cup includes: a dust cup body having a cyclone chamber enclosure plate, and a cyclone is arranged in a region enclosed by the cyclone chamber enclosure plate; and a cover plate detachably connected to the dust cup body, and a cyclone cavity is formed between the cyclone chamber enclosure plate and the cover plate.

12 Claims, 5 Drawing Sheets

(56) References Cited

U.S. PATENT DOCUMENTS

| | | | | |
|---|---|---|---|---|
| 2002/0088077 | A1* | 7/2002 | Thur | A47L 9/0009<br>15/352 |
| 2002/0088079 | A1* | 7/2002 | Oh | A47L 9/1608<br>15/352 |
| 2006/0137302 | A1* | 6/2006 | Min | A47L 9/1666<br>55/337 |
| 2009/0056060 | A1* | 3/2009 | Han | A47L 9/1691<br>15/159.1 |
| 2018/0177352 | A1* | 6/2018 | Conrad | A47L 9/2884 |

FOREIGN PATENT DOCUMENTS

| | | | | |
|---|---|---|---|---|
| CN | 209153420 | U | 7/2019 | |
| CN | 209186551 | U | 8/2019 | |
| CN | 110279345 | A | 9/2019 | |
| CN | 211299803 | U | 8/2020 | |
| JP | 2003310505 | A | 11/2003 | |
| JP | 5789682 | B2 | 10/2015 | |
| WO | WO-2009139556 | A2 * | 11/2009 | A47L 9/16 |

OTHER PUBLICATIONS

Extended European Search Report issued Dec. 9, 2022 regarding Application No. 20899718.9.

* cited by examiner

DUST CUP AND VACUUM CLEANER HAVING THE SAME

CROSS-REFERENCES TO RELATED APPLICATIONS

The present disclosure is a national phase application of International Application No. PCT/CN2020/112895, filed on Sep. 1, 2020, which claims a priority to Patent Application No. 201911283764.5, filed on Dec. 13, 2019, the entireties of which are herein incorporated by reference.

FIELD

The present disclosure relates to the field of household appliances, in particular, to a dust cup and a vacuum cleaner having the same.

BACKGROUND

For a vacuum cleaner with a cyclone in the related art, when an air sucked into a dust cup has debris such as hair and paper strips, the hair and the paper strips tend to be wound around a cyclone, and these hair and paper strips is not convenient for a user to be cleaned manually. The hair and the paper strips wound around the cyclone would reduce a dust removal effect of the cyclone, and would result in failure of the cyclone in a severe case.

SUMMARY

The present disclosure aims to solve one of the above problems in the related art at least to a certain extent. To this end, the present disclosure proposes a dust cup, which can easily clean up debris such as hair and paper strips wound around the cyclone.

The present disclosure also proposes a vacuum cleaner with the above dust cup.

The dust cup according to embodiments of the present disclosure includes: a dust cup body having a cyclone chamber enclosure plate, and a cyclone is arranged in a region enclosed by the cyclone chamber enclosure plate; and a cover plate detachably connected to the dust cup body, and a cyclone cavity is formed between the cyclone chamber enclosure plate and the cover plate.

In the dust cup according to the embodiments of the present disclosure, the cover plate is detachably connected to the dust cup body, and the cyclone can be exposed after removed, which can facilitate cleaning the hair and the paper strips wound around the cyclone by an user, and advantageously maintaining a dust removal effect of the cyclone.

According to some embodiments of the present disclosure, the cover plate includes a cover plate body and a protruding portion connected to the cover plate body. The protruding portion overlaps with the cyclone chamber enclosure plate.

Further, the protruding portion has a dust throwing port defined thereon, and the dust throwing port is in communication with the cyclone cavity. The dust cup body has a dust collecting chamber defined therein, and the dust collecting chamber is in communication with the cyclone cavity through the dust throwing port.

Further, the dust throwing port has a guide rib provided on a side thereof facing away from the cover body, and the guide rib is configured to extend into the dust collecting chamber.

According to some embodiments of the present disclosure, the dust cup body has an air inlet defined thereon, and the cover plate has an air outlet defined thereon. Each of the air inlet and the air outlet is in communication with the cyclone cavity.

According to some embodiments of the present disclosure, the dust cup body has a vent passage defined thereon, and the vent passage is located between an outer wall of the cyclone chamber enclosure plate and an inner wall of the dust cup body. Further, the vent passage is in communication with the cyclone cavity and aligned with the air outlet.

Further, the vent passage is arranged parallel to a length direction of the dust cup body.

Further, an included angle formed between the cover plate and the length direction of the dust cup body is an acute angle. Further, the cover plate has an upper end inclined in a direction close to the cyclone cavity and a lower end inclined in a direction facing away from the cyclone cavity.

According to some embodiments of the present disclosure, the cover plate has a handle provided on a side thereof facing away from the dust cup body.

A vacuum cleaner according to another embodiment of the present disclosure includes a cleaner body and the dust cup as described above. The cleaner body has a suction port, a first body air inlet, a second body air inlet and a body air outlet that are provided thereon. The first body air inlet is in communication with the suction port, and the second body air inlet is in communication with the body air outlet. The air inlet of the dust cup is in communication with the first body air inlet, and the air outlet of the dust cup is in communication with the second body air inlet.

Further, the cleaner body includes a main body and a body guide portion. The suction port and the first body air inlet are located on the body guide portion, and the second body air inlet and the body air outlet are located on the main body. A region surrounded by the main body and the body guide portion is a dust cup accommodation portion in which the dust cup is arranged.

Further, the vacuum cleaner also includes a motor located in an airflow path between the second body air inlet and the body air outlet. The main body has a motor accommodation portion provided thereon, and the motor is disposed within the motor accommodation portion.

Further, a filter assembly is disposed between the second body air inlet and the body air outlet, and the motor is located at a downstream side of the filter assembly.

Further, the main body further has a handhold, and the dust cup accommodation portion is located on a side of the motor accommodation portion facing away from the handhold.

Further, one of the cover plate and the main body has a positioning protrusion provided thereon, and the other of the cover plate and the main body has a positioning groove defined therein. The positioning protrusion is adapted to extend into the positioning groove.

Further, the dust cup body has a dust cup body lock catch provided on an end thereof facing away from the cover plate, and the body guide portion has a lock catch rotation shaft provided thereon. The dust cup body lock catch is connected to the lock catch rotation shaft.

Further, the dust cup body has a dust cup body locking hook provided on an end thereof close to the cover plate, and the body guide portion has a cleaner body locking hook groove defined therein. The dust cup body locking hook is adapted to be locked to or unlocked from the cleaner body locking hook groove. The dust cup body lock catch is adapted to rotate around the lock catch rotation shaft after the dust cup body locking hook is unlocked from the cleaner body locking hook groove.

Further, the cover plate is adapted to be attached with a surface of the main body facing towards the dust cup accommodation portion.

Additional aspects and advantages of the present disclosure will be set forth, in part, from the following description, and in part will become apparent from the following description, or may be learned by practice of the present disclosure.

Figure 1:
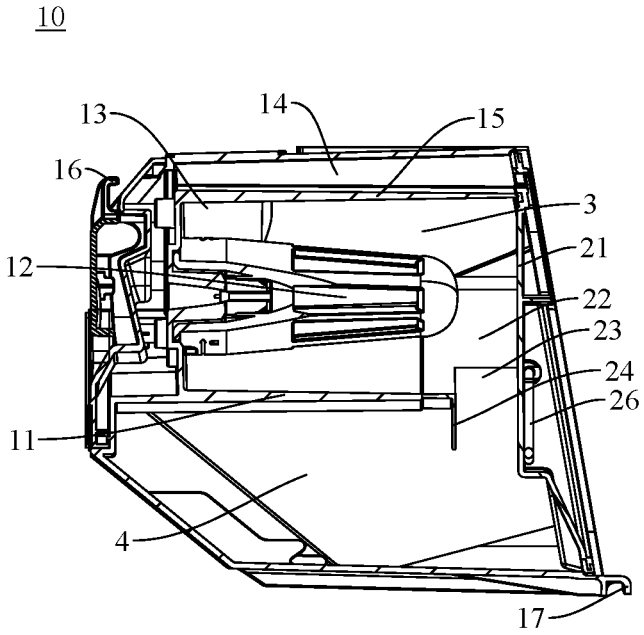
FIG. 1 is a schematic assembly view of a dust cup body and a cover plate.

REFERENCE SIGNS dust cup body 1, cyclone chamber enclosure plate 11, cyclone 12, air inlet 13, vent passage 14, partition plate 15, dust cup body lock catch 16, dust cup body locking hook 17, cover plate 2, cover plate body 21, protruding portion 22, dust throwing port 23, guide rib 24, air outlet 25, handle 26, positioning groove 27, cyclone cavity 3, dust collecting chamber 4, dust cup 10, body guide portion 201, suction port 2011, first body air inlet 2012, lock catch rotation shaft 2013, main body 202, second body air inlet 2021, body air outlet 2022, positioning protrusion 2023, cleaner body locking hook groove 2024, dust cup accommodation portion 203, motor accommodation portion 204, motor 2041, filter assembly 205, coarse filter element 2051, fine filter element 2052, filter element cover plate 2053, notch 2054, air conduit 206, handhold 207, cleaner body 20.

DETAILED DESCRIPTION OF THE DISCLOSURE

The embodiments of the present disclosure are described in detail below. Examples of the embodiments are shown in the accompanying drawings, in which the same or similar reference numerals indicate the same or similar elements or elements having the same or similar functions. The embodiments described below with reference to the accompanying drawings are exemplary, and are intended to explain the present disclosure, rather than being construed as limiting the present disclosure.

In the description of the present disclosure, it should be understood that the orientation or position relationship indicated by the terms "upper", "lower", "inner", and "outer", etc. is based on the orientation or position relationship shown in the drawings, and is only for the convenience of describing the present disclosure and simplifying the description, rather than indicating or implying that the described device or element must have a specific orientation, or be constructed and operated in a specific orientation, and therefore cannot be understood as a limitation to the present disclosure.

In addition, the terms "first" and "second" are only used for descriptive purposes, and cannot be understood as indicating or implying relative importance or implicitly indicating the number of the indicated features. Therefore, the features defined with "first" and "second" may explicitly or implicitly include one or more of the features. In the description of the present disclosure, "a plurality of" means at least two, such as two, three, etc., unless otherwise specifically defined.

In the present disclosure, unless otherwise clearly specified and limited, terms such as "installed", "mounted", "connected to", "connected with", "fixed" and the like should be understood in a broad sense. For example, it may be a fixed connection or a detachable connection or an integral connection; it may be mechanical connection or electrical connection or communicate with each other; it may be direct connection or indirect connection by an intermediate; it may be internal communication of two components or an interaction relationship between two components. The specific meaning of the above-mentioned terms in the present disclosure should be understood according to specific circumstances.

A dust cup 10 according to embodiments of the present disclosure will be described in detail below with reference to FIGS. 1 to 9.

Referring to FIGS. 1 to 6, the dust cup 10 includes a dust cup body 1 and a cover plate 2.

The dust cup body 1 has a cyclone chamber enclosure plate 11, and a cyclone 12 is arranged in a region enclosed by the cyclone chamber enclosure plate 11. After entering the dust cup body 1, an airflow entrained with dust, hair, paper strips and other debris is guided into the cyclone 12 by the cyclone chamber enclosure plate 11 for a rotation movement. Dust and debris of larger particles are separated from the airflow by a centrifugal force, and the hair and the paper strips may be wound around the cyclone 12.

The cover plate 2 is detachably connected to the dust cup body 1. A cyclone cavity 3 is formed between the cyclone chamber enclosure plate 11 and the cover plate 2, and the cyclone 12 is disposed in the cyclone cavity 3. That is, the cyclone 12 may be exposed by removing the cover plate 2, which facilitates cleaning the debris such as the hair and the paper strips wound around the cyclone 12 by a user, and avoiding a dust removal effect from being affected due to a blocking of the cyclone 12 by the debris.

In the dust cup 10 according to the present disclosure, the cover plate 2 is detachably connected to the dust cup body 1, and the cyclone 12 can be exposed after the cover plate 2 is removed, which facilitates cleaning the hair and the paper strips wound around the cyclone 12 by the user, and maintaining the dust removal effect of the cyclone 12.

Figure 4:
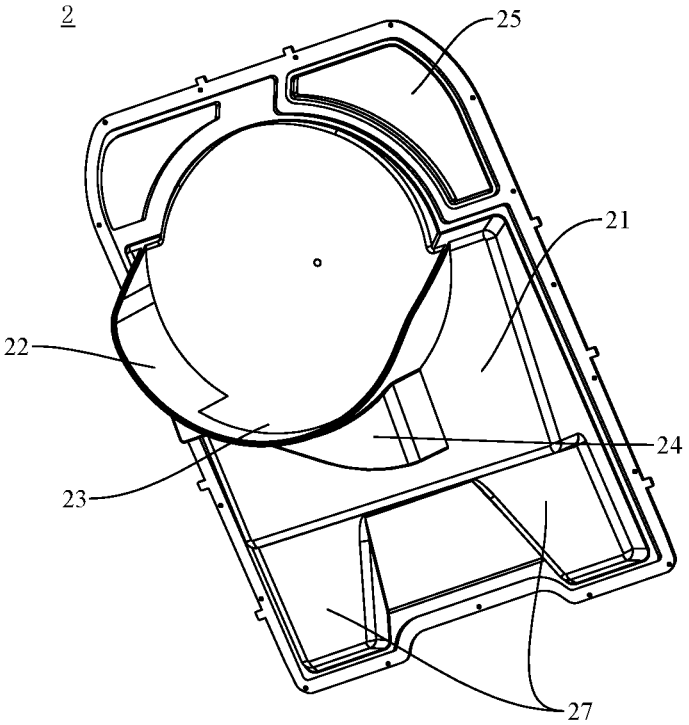
FIG. 4 is a perspective view of the cover plate.

Referring to FIGS. 1 and 4, the cover plate 2 includes a cover plate body 21 and a protruding portion 22. The cover plate body 21 and the dust cup body 1 may be connected by snaps, and the protruding portion 22 is connected to the cover plate body 21. The protruding portion 22 is located on a side of the cover plate body 21 facing towards the dust cup body 1, and the protruding portion 22 overlaps with the cyclone chamber enclosure plate 11 to form the cyclone cavity 3.

Referring to FIGS. 1 and 4, the protruding portion 22 has a dust throwing port 23 defined thereon, and the dust throwing port 23 is in communication with the cyclone cavity 3. The dust cup body 1 has a dust collecting chamber 4 defined therein, and the dust collecting chamber 4 is in communication with the cyclone cavity 3 through the dust throwing port 23.

In one embodiment, after the protruding portion 22 overlaps with the cyclone chamber enclosure plate 11, the dust cup body 1 is divided into the cyclone cavity 3 and the dust collecting chamber 4. The cyclone cavity 3 is located above the dust collecting chamber 4. The dust and debris of larger particles are separated from the airflow in the cyclone cavity 3 and enters the dust collecting chamber 4 located below the cyclone cavity 3 through the dust throwing port 23. The dust collecting chamber 4 is configured to store the dust and debris discharged from the cyclone 12.

Referring to FIGS. 1, 2, 4 and 6, the dust throwing port 23 has a guide rib 24 provided on a side thereof facing away from the cover plate body 21, and the guide rib 24 extends into the dust collecting chamber 4 to guide the dust and debris to position below the dust collecting chamber 4, which can also prevent the dust in the dust collecting chamber 4 from entering the cyclone cavity 3. It should be noted that the dust throwing port 23 is formed between the guide rib 24 and the cover plate body 21.

Referring to FIGS. 1 to 4, the dust cup body 1 has an air inlet 13 defined thereon, and the cover plate 2 has an air outlet 25 defined thereon. Each of the air inlet 13 and the air outlet 25 is in communication with the cyclone cavity 3.

In one embodiment, the airflow entrained with the dust, the hair, the paper strips and other debris enters the cyclone cavity 3 of the dust cup body 1 through the air inlet 13, and the airflow dedusted by the cyclone cavity 3 is discharged out of the dust cup body 1 through the air outlet 25.

Referring to FIGS. 1 to 6, the dust cup body 1 has a vent passage 14 defined thereon, and the vent passage 14 is located between an outer wall of the cyclone chamber enclosure plate 11 and an inner wall of the dust cup body 1. Further, the vent passage 14 is in communication with the cyclone cavity 3 and aligned with the air outlet 25.

Figure 3:
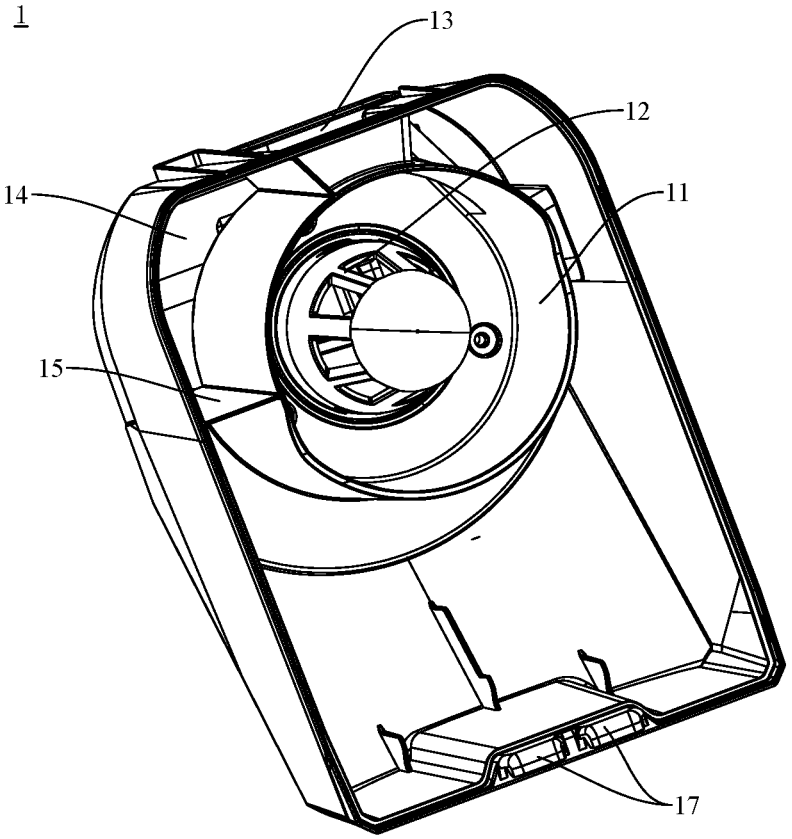
FIG. 3 is a perspective view of the dust cup body.

In one embodiment, as shown in FIG. 3, the dust cup body 1 is provided with a partition plate 15 configured to separate the dust collecting chamber 4 and the vent passage 14, to separate the vent passage 14 from the dust collecting chamber 4. In addition, after a preliminary dust removal is performed in the cyclone cavity 3, the airflow in the cyclone cavity 3 can be discharged through the vent passage 14.

Referring to the embodiment shown in FIG. 1, the vent passage 14 is arranged parallel to a length direction of the dust cup body 1.

Referring to the embodiment shown in FIG. 1, an included angle formed between the cover plate 2 and the length direction of the dust cup body 1 is an acute angle, and the cover plate 2 has an upper end inclined in a direction close to the cyclone cavity 3 and a lower end inclined in a direction facing away from the cyclone cavity 3.

Figure 2:
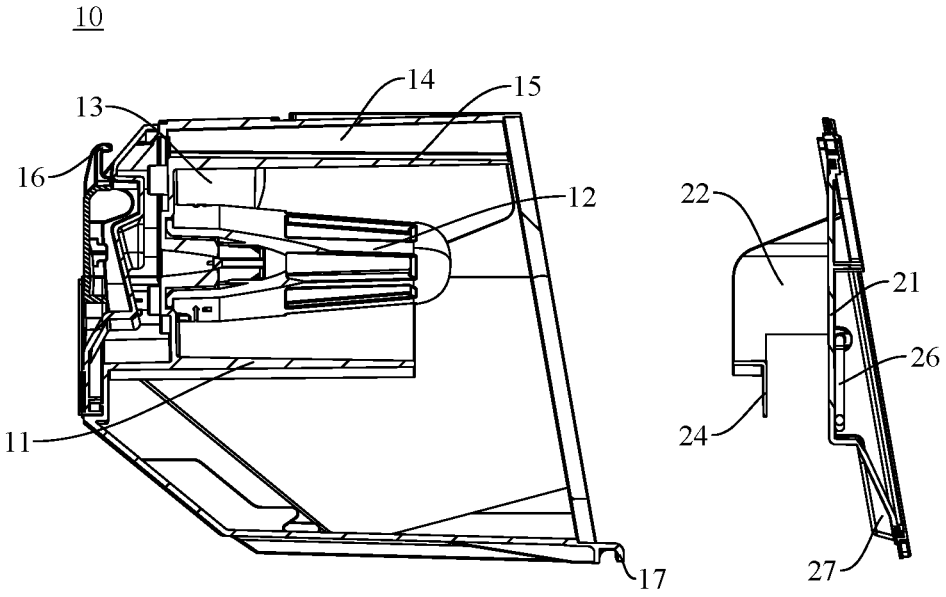
FIG. 2 is a schematic exploded view of a dust cup body and a cover plate.
Figure 5:
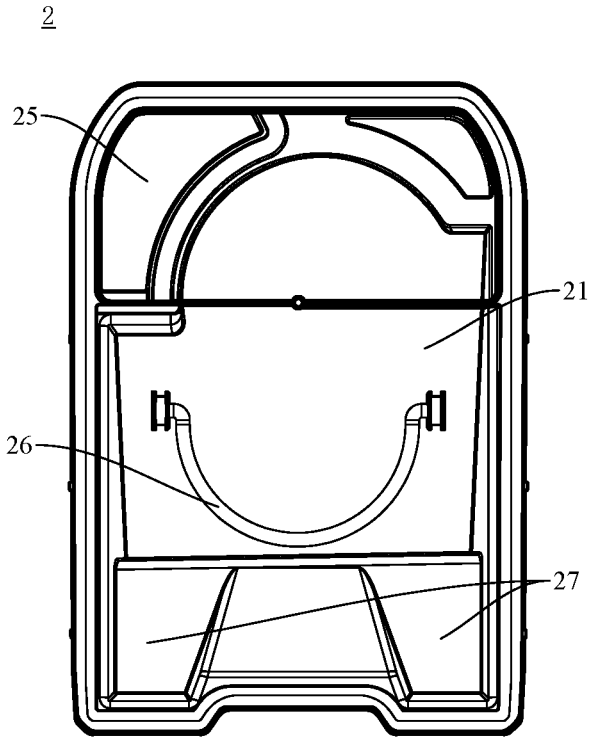
FIG. 5 is a front view of the cover plate.
Figure 6:
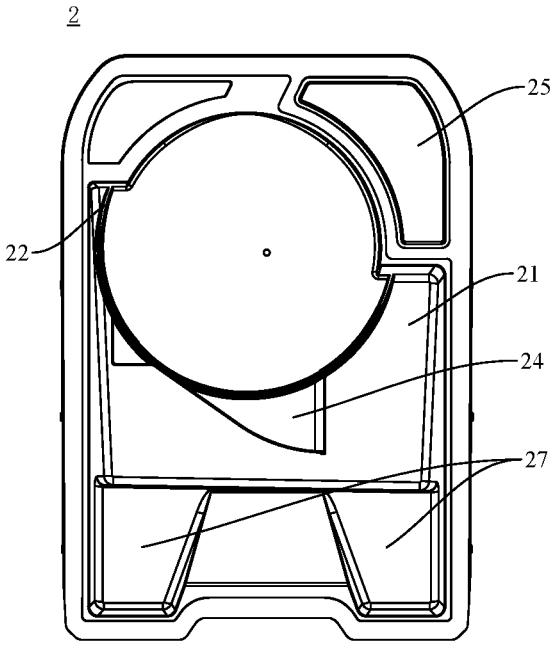
FIG. 6 is a rear view of the cover plate.

Referring to FIGS. 1, 2 and 5, the cover plate 2 has a handle 26 provided on a side thereof facing away from the dust cup body 1.

In one embodiment, the cover plate 2 and the dust cup body 1 can be connected to each other by snaps. The cover plate 2 has a rotatable handle 26 provided on a side thereof facing away from the dust cup body 1. When the cover plate 2 needs to be detached, the handle 26 can be rotate to facilitate the detaching of the cover plate 2 by pulling the handle 26.

Referring to FIGS. 1 to 9, a vacuum cleaner according to another aspect of embodiments of the present disclosure includes the dust cup 10 as described in the above embodiments. The vacuum cleaner also includes a cleaner body 20. The cleaner body 20 has a suction port 2011, a first body air inlet 2012, a second body air inlet 2021 and a body air outlet 2022 that are provided thereon. The first body air inlet 2012 is in communication with the suction port 2011, and the second body air inlet 2021 is in communication with the body air outlet 2022.

The air inlet 13 of the dust cup 10 is in communication with the first body air inlet 2012, and the air outlet 25 of the dust cup 10 is in communication with the second body air inlet 2021.

In one embodiment, the airflow can suck the dust, the hair, the paper strips and other debris into the suction port 2011, and enters the air inlet 13 through the first body air inlet 2012. After separated by the cyclone 12, most of the dust and the debris enter the second body air inlet 2021 through the vent passage 14 and the air outlet 25, and finally are discharged from the body air outlet 2022.

Figure 7:
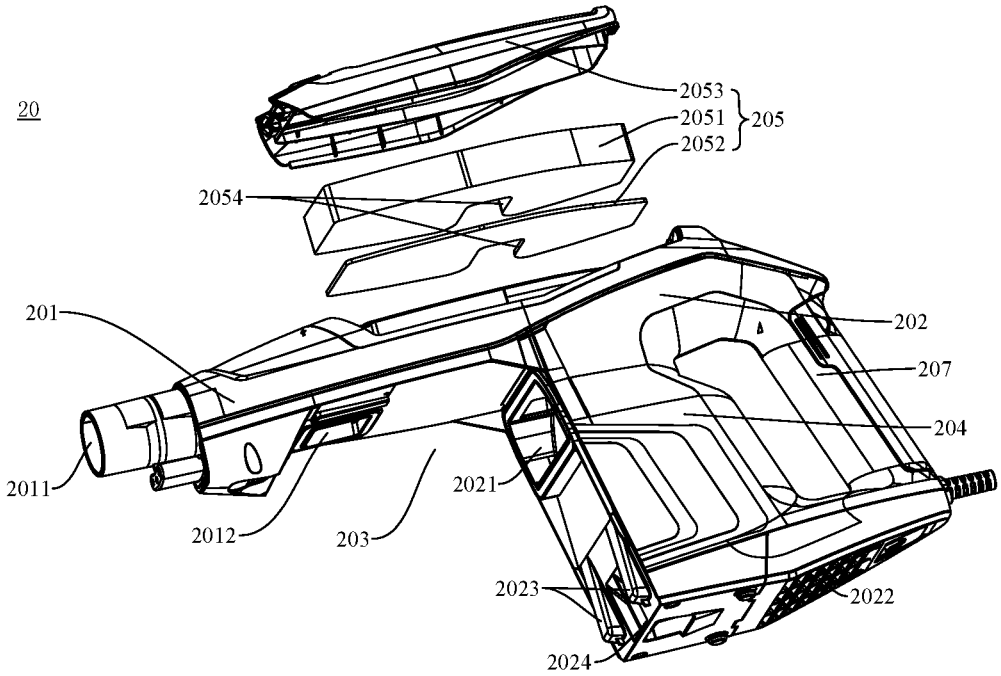
FIG. 7 is an exploded view of a cleaner body of a vacuum cleaner.
Figure 8:
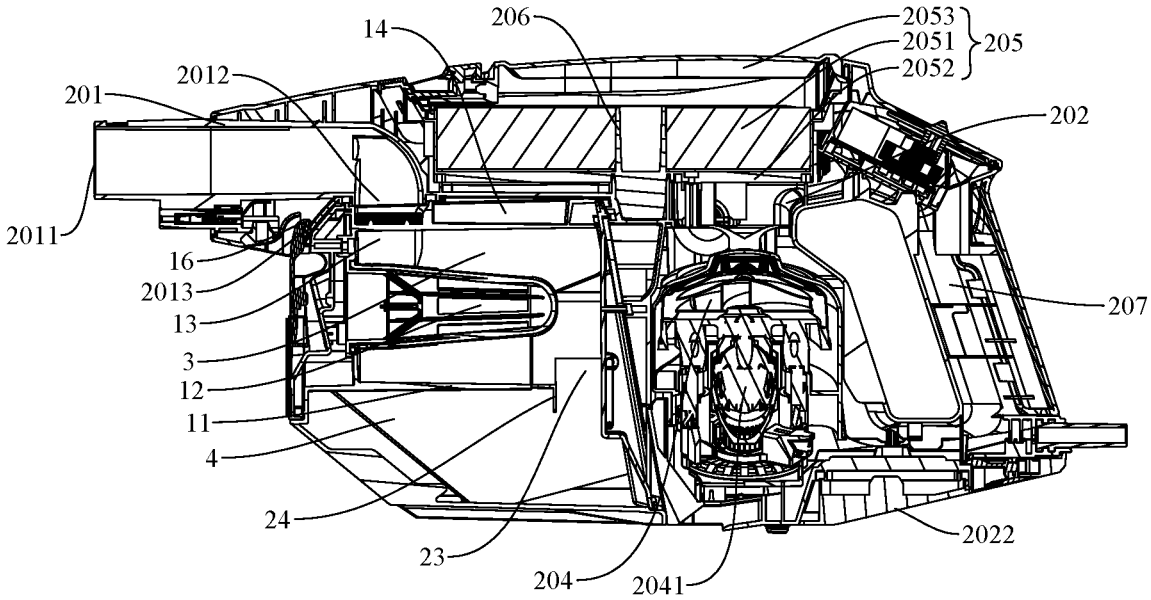
FIG. 8 is a schematic view of the vacuum cleaner.

Referring to FIGS. 7 and 8, the cleaner body 20 includes a main body 202 and a body guide portion 20 configured to guide the airflow into the dust cup 10. The suction port 2011 and the first body air inlet 2012 are located on the body guide portion 201, and the second body air inlet 2021 and the body air outlet 2022 are located on the main body 202. A region surrounded by the main body 202 and the body guide portion 201 is a dust cup accommodation portion 203 in which the dust cup 10 is arranged.

Referring to FIGS. 7 and 8, the vacuum cleaner also includes a motor 2041. The main body 202 has a motor accommodation portion 204 provided thereon, and the motor 2041 is disposed within the motor accommodation portion 204. Further, the motor 2041 is located in an airflow path between the second body air inlet 2021 and the body air outlet 2022 to cool down the motor 2041 by the airflow.

In one embodiment, the motor 2041 is configured to drive blades to rotate at a high speed, which generates negative air pressure in the cleaner body 20 to form the airflow, and the dust, the hair, the paper strips and other debris in turn are sucked into the suction port 2011 by the airflow, and a clean airflow is discharged through the body air outlet 2022.

Referring to FIGS. 7 and 8, a filter assembly 205 is disposed between the second body air inlet 2021 and the body air outlet 2022, and the motor 204 is located at a downstream side of the filter assembly 205.

In one embodiment, the filter assembly 205 is configured to filter dust and debris of small particles that are not filtered out in the dust cup 10. The filter assembly 205 includes a coarse filter element 2051, a fine filter element 2052 and a filter element cover plate 2053. Each of the coarse filter element 2051 and the fine filter element 2052 has a notch 2054 provided thereon. An air conduit 206 is disposed between the second body air inlet 2021 and the filter assembly 205, and the air conduit 206 passes through the notch 2054 of each of the fine filter element 2052 and the coarse filter element 2051. The air conduit 206 is in communication with the second body air inlet 2021 at one end thereof, and the other end of the air conduit 206 faces towards the filter element cover plate 2053. The filter element cover plate 2053 is located at an upper end of the filter assembly 205 and is connected with the cleaner body 20 in a sealed manner, and the airflow entering the filter assembly 205 from the second body air inlet 2021 along the air conduit 206 may only pass through the coarse filter element 2051 and the fine filter element 2052 sequentially from top to bottom, and facilitating preventing the second body air inlet 2021 from being blocked by the dust and the debris filtered by the filter assembly 205. The motor 204 is located on the downstream side of the filter assembly 205, which is beneficial to prevent the dust from being brought into the motor 204 by the airflow, and improving service life of the motor 204. In one embodiment, the filter assembly 205 has a detachable structure, to facilitate removing the dust in the filter assembly 205 by the user. In one embodiment, the coarse filter element 2051 is a sponge, and the fine filter element 2052 is HEPA.

Figure 9:
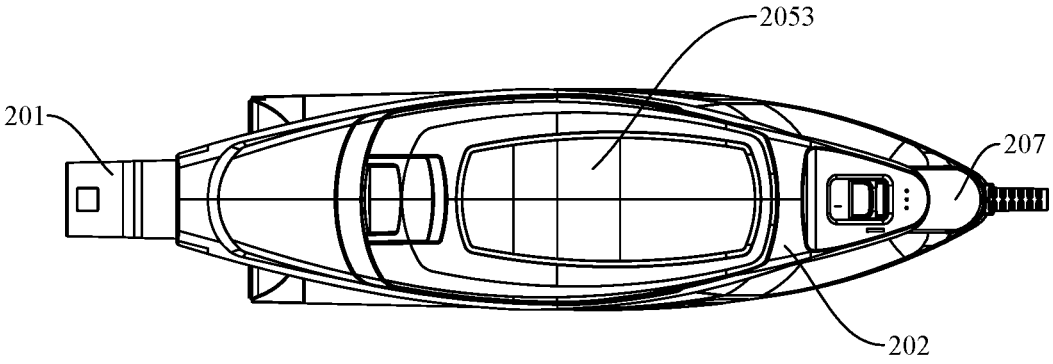
FIG. 9 is a plan view of the vacuum cleaner.

Referring to FIGS. 7 to 9, the main body 202 also has a handhold 207 for easy use of the vacuum cleaner. The dust cup accommodating portion 207 is located on the side of the motor accommodating portion 204 facing away from the handhold 207.

Further, one of the cover plate 2 and the main body 202 has a positioning protrusion 2023 provided thereon, and the other of the cover plate 2 and the main body 202 has a positioning groove 27 defined therein. Referring to the embodiment shown in FIGS. 5 and 7, the cover plate 2 has a positioning groove 27 defined thereon, and the main body 202 of the cleaner body 20 has a positioning protrusion 2023 provided thereon. The positioning protrusion 2023 is adapted to insert into the positioning groove 27 to position the cover plate 2 on the cleaner body 20.

Referring to FIGS. 1 and 8, the dust cup body 1 has a dust cup body lock catch 16 provided on an end thereof facing away from the cover plate 2, and the body guide portion 201 has a lock catch rotation shaft 2013 provided thereon. The dust cup body lock catch 16 is connected to the lock catch rotation shaft in such a manner that an end of the dust cup 10 is rotatably connected to the cleaner body 20.

Referring to FIGS. 1 and 7, the dust cup body 1 has a dust cup body locking hook 17 provided on an end thereof close to the cover plate 2, and the body guide portion 201 has a cleaner body locking hook groove 2024 defined therein. The dust cup body locking hook 17 is adapted to be locked to or unlocked from the cleaner body locking hook groove 2024. When the dust cup body locking hook 17 is locked with the cleaner body locking hook groove 2024, the dust cup 10 is fixed on the cleaner body 20. In this case, the vacuum cleaner can perform cleaning operation. The dust cup body locking hook 16 is adapted to rotate around the lock rotation shaft 2013 to expose the cover plate 2 after the dust cup body locking hook 17 is unlocked from the cleaner body locking hook groove 2024. In addition, by further removing the cover plate 2, the hair and the paper strips on the cyclone 12 and the dust and the debris in the dust collecting chamber 4 can be cleaned.

Further, the cover plate 2 is adapted to be attached with a surface of the main body 202 facing towards the dust cup accommodation portion 203, and after the dust cup 10 is placed in the dust cup accommodation portion 203, the air outlet 25 of the dust cup 10 is in communication with the second body air inlet 2021.

In the description of this specification, descriptions with reference to the terms "an embodiment", "some embodiments", "examples", "specific examples", or "some examples" etc. mean that specific features, structure, materials or characteristics described in conjunction with the embodiment or example are included in at least one embodiment or example of the present disclosure. In this specification, the schematic representations of the above terms do not necessarily refer to the same embodiment or example. In one embodiment, the described specific features, structures, materials or characteristics may be combined in any one or more embodiments or examples in a suitable manner. In addition, the different embodiments or examples described in this specification can be combined.

Although the embodiments of the present disclosure have been shown and described above, it should be understood that the above embodiments are exemplary and should not be construed as limiting the present disclosure. Changes, modifications, substitutions and modifications can be made to the above embodiments within the scope of the present disclosure.

What is claimed is:

1. A dust cup, comprising:

a dust cup body having a cyclone chamber enclosure plate, wherein a cyclone is arranged in a region enclosed by the cyclone chamber enclosure plate; and a cover plate detachably connected to the dust cup body, wherein a cyclone cavity is formed between the cyclone chamber enclosure plate and the cover plate;

wherein the cover plate comprises a cover plate body and a protruding portion connected to the cover plate body, the protruding portion overlapping with the cyclone chamber enclosure plate to form the cyclone cavity;

wherein the dust cup body has an air inlet defined thereon, and the cover plate has an air outlet defined thereon, each of the air inlet and the air outlet being in communication with the cyclone cavity;

wherein the dust cup body has a vent passage defined thereon, the vent passage is enclosed by an outer wall of the cyclone chamber enclosure plate, an inner wall of the dust cup body and the cover plate; the vent passage is outside and separate from the cyclone cavity, being in communication with the cyclone cavity, and the vent passage is aligned with the air outlet.

2. The dust cup according to claim 1, wherein the protruding portion has a dust throwing port defined thereon, the dust throwing port being in communication with the cyclone cavity, and wherein the dust cup body has a dust collecting chamber defined therein, the dust collecting chamber being in communication with the cyclone cavity through the dust throwing port.

3. The dust cup according to claim 2, wherein the dust throwing port has a guide rib provided on a side thereof facing away from the cover plate body, the guide rib being configured to extend into the dust collecting chamber.

4. The dust cup according to claim 1, wherein the vent passage is arranged parallel to a length direction of the dust cup body.

5. The dust cup according to claim 4, wherein an included angle formed between the cover plate and the length direction of the dust cup body is an acute angle, and wherein the cover plate has an upper end inclined in a direction close to the cyclone cavity and a lower end inclined in a direction facing away from the cyclone cavity.

6. The dust cup according to claim 1, wherein the cover plate has a handle provided on a side thereof facing away from the dust cup body.

7. A vacuum cleaner, comprising:

a cleaner body having a suction port, a first body air inlet, a second body air inlet and a body air outlet that are provided thereon, the first body air inlet being in communication with the suction port, and the second body air inlet being in communication with the body air outlet; and a dust cup, comprising:

a dust cup body having a cyclone chamber enclosure plate, wherein a cyclone is arranged in a region enclosed by the cyclone chamber enclosure plate; and a cover plate detachably connected to the dust cup body, wherein a cyclone cavity is formed between the cyclone chamber enclosure plate and the cover plate, wherein an air inlet of the dust cup is in communication with the first body air inlet, and an air outlet of the dust cup is in communication with the second body air inlet;

wherein the cleaner body comprises a main body and a body guide portion, wherein the suction port and the first body air inlet are located on the body guide portion, wherein the second body air inlet and the body air outlet are located on the main body, and wherein a region surrounded by the main body and the body guide portion is a dust cup accommodation portion in which the dust cup is arranged;

wherein the dust cup body has a dust cup body lock catch provided on an end thereof facing away from the cover plate, and the body guide portion has a lock catch rotation shaft provided thereon, the dust cup body lock catch being connected to the lock catch rotation shaft;

wherein the dust cup body has a dust cup body locking hook provided on an end thereof close to the cover plate, and the main body has a cleaner body locking hook groove defined therein between the second body air inlet and the body air outlet, the dust cup body locking hook being adapted to be locked to or unlocked from the cleaner body locking hook groove, and wherein the dust cup body lock catch is adapted to rotate around the lock catch rotation shaft after the dust cup body locking hook is unlocked from the cleaner body locking hook groove.

8. The vacuum cleaner according to claim 7, further comprising a motor located in an airflow path between the second body air inlet and the body air outlet, wherein the main body has a motor accommodation portion provided thereon, the motor being disposed within the motor accommodation portion.

9. The vacuum cleaner according to claim 8, wherein a filter assembly is disposed between the second body air inlet and the body air outlet, and wherein the motor is located at a downstream side of the filter assembly.

10. The vacuum cleaner according to claim 8, wherein the main body further has a handhold, and the dust cup accommodation portion is located on a side of the motor accommodation portion facing away from the handhold.

11. The vacuum cleaner according to claim 7, wherein a first of the cover plate and the main body has a positioning protrusion provided thereon, and a second of the cover plate and the main body has a positioning groove defined therein, the positioning protrusion being adapted to extend into the positioning groove.

12. The vacuum cleaner according to claim 7, wherein the cover plate is adapted to be attached with a surface of the main body facing towards the dust cup accommodation portion.

* * * * *